United States Patent [19]

Fenwick

[11] 4,290,071

[45] Sep. 15, 1981

[54] MULTI-BAND DIRECTIONAL ANTENNA

[75] Inventor: Richard C. Fenwick, Dallas, Tex.

[73] Assignee: Electrospace Systems, Inc., Richardson, Tex.

[21] Appl. No.: 863,619

[22] Filed: Dec. 23, 1977

[51] Int. Cl.[3] ..... H01Q 19/30

[52] U.S. Cl. ..... 343/819; 343/815; 343/834; 343/833

[58] Field of Search ..... 343/833, 834, 835, 836, 343/844, 876, 817, 818, 819, 853, 822

[56] References Cited

U.S. PATENT DOCUMENTS

| | | | |
|---|---|---|---|
| 3,996,592 | 12/1976 | Kline et al. | 343/876 |
| 4,122,447 | 10/1978 | Kawai et al. | 343/853 |
| 4,145,694 | 3/1979 | Sletten | 343/876 |

*Primary Examiner*—David K. Moore
*Attorney, Agent, or Firm*—Warren H. Kintzinger

[57] ABSTRACT

A multi-band multi-element directional antenna array having a driven element and at least one parasitic element with a network at the center of each element interconnecting element opposite side radiators. While some of these would be a driven element and either a reflector or director parasitic element array most applications call for at least three elements, a driven element, a reflector element and a director element, and for some applications, additional parasitic director elements are added. While antenna arrays embodying features hereof may be adapted as two band $f_1$ $f_2$, $f_2$ $f_3$, or $f_1$ $f_3$ antenna arrays, primary useage would be in a three radio band $f_1$, $f_2$, $f_3$ version with band nominal center frequencies related, approximately by the progression 1, 1.5, 2 (example 14, 21, and 28 MHz). Reflector and director elements with their center networks as parasitic elements are structured to resonate at frequencies up to ten percent displaced from respective band operating frequencies—reflector elements at lower frequencies and directors at higher frequencies. Some of the arrays employ folded elements for improved unidirectional radiation patterns and structural advantages.

32 Claims, 19 Drawing Figures

$f_3 = 2f_1$ $f_2 = 1.5f_1$

MULTI-BAND DIRECTIONAL ANTENNA

Figure 1:
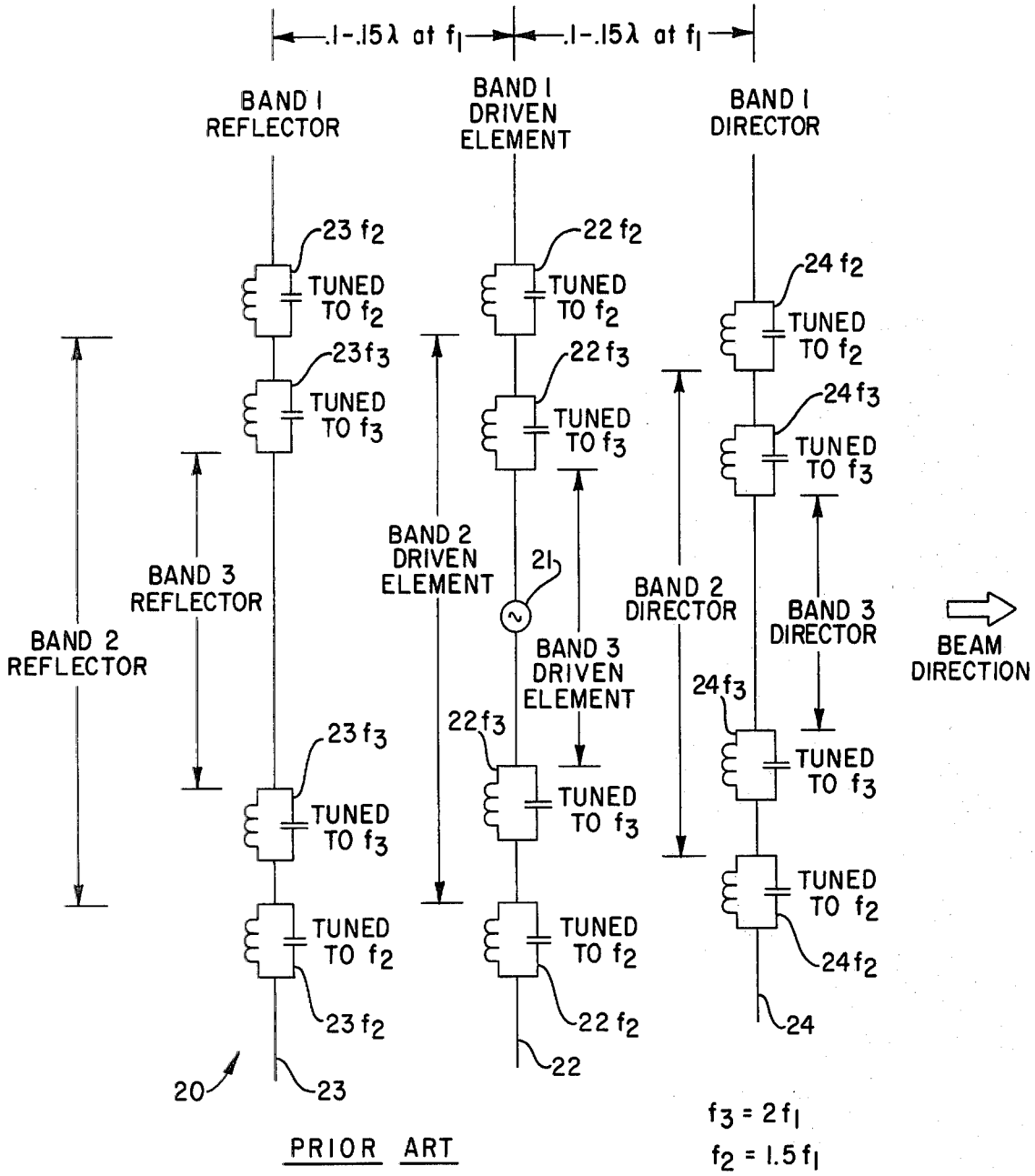
PRIOR ART FIG. 1

This invention relates in general to multi-band directional antennas, and in particular, to two and three band multi-element directional array antennas having a matching network at the center of each of a plurality of elements. The antenna structure typically, in the three element approach, presents an antenna having a unidirectional radiation pattern and matched input impedance on three radio frequency bands with center frequencies $f_1$, $f_2$, and $f_3$ related in approximation by the progression 1, 1.5, 2.

Various prior art antenna structures have been devised to provide, with each, a unidirectional matched antenna for operation on frequency bands related approximately in frequency by the progression 1, 1.5, 2, in particular, for operation in bands assigned at 14, 21, and 28 MHz. In one of these approaches, a fed driven element and a parasitic (non-fed) reflector and director elements are used in such a way that, effectively, a multi-element "Yagi" antenna with two or more elements approximately a half wave long is effectively provided on each band. With a "trap" antenna approach, each element has tuned circuits to isolate the element currents to the element section between the traps tuned to that particular frequency. With such "trap" antennas, the reflector elements are resonated at a frequency slightly lower than the operating frequency—typically less than ten percent lower, and director elements are resonated at a frequency slightly higher than the operating frequency. In another antenna approach, separate elements are used for each frequency band with the driven element for each band approximately one-half wavelength long, and the corresponding reflector and director elements slightly longer and shorter respectively, than the respective driven element. Many various composite combinations of these antenna structures have been used such as, for example, separate parasitic elements for the highest frequency band and with two-band trapped elements for the two other bands of a three band antenna. Antenna array systems have also been devised with a single parasitic element, reflector or director, and also systems using a single reflector and multiple directors. These various approaches have various problems such as a requirement for a large number of tuned traps; or elements must be provided each performing a useful function on only one band; and the full aperture of the antenna is utilized only on the lowest frequency band.

It is therefore a principal object of this invention to provide a higly efficient multi-band multi-element parasitic array antenna in which the full length of each element is used on each band.

Another object is to provide such a multi-element parasitic array antenna wherein each element requires only a single matching circuit at its center.

A further object is to provide such an antenna in the form of a three band multi-element parasitic array antenna.

Still another object is to provide a highly efficient antenna having advantageously, increased gain and more narrow beam width on the higher frequency bands.

Another object is for the antenna to have approximately the same input impedance (such as approximately 50 ohms input impedance) on all three bands (when the multi-band antenna is a three band antenna).

Features of this invention useful in accomplishing the above objects include: in a multi-band multi-element parasitic array antenna, a three band antenna with a driven element having two half wave radiators on a middle band of the three, frequency bands of the antenna, a reflector up to 10 percent longer than the driven element, and a director shorter by as much as 10 percent from the driven element length. The reflector and director parasitic elements are provided with networks that enable that respective elements to respond as required at all three operational bands, and a network is provided which matches the driven element to the feedline on all three bands. The parasitic element networks are structured to provide a capacitive impedance at the low band frequency, a very high impedance at the middle band frequency, and an inductive impedance at the high band frequency. The driven element matching network includes a series capacitor and series inductor that resonate the driven element at the low and high band frequencies, and a transmission line transformer is included of a predetermined length L (three quarters wavelength at the middle frequency) that transforms the high value of driven element input impedance ($Z_a$) at the middle frequency to a lower value of input impedance ($Z_{in}$), appearing at a coupling transformer, equal to the value $Z_a$ for the other two bands. With the three radio frequency bands $f_1$, $f_2$, and $f_3$ related in approximation by the progression 1, 1.5, 2, and transmission line transformer length L a half wavelength at $f_1$, and one wavelength at $f_3$, $Z_{in}=Z_a$ on those two bands regardless of the value of transmission line characteristic impedance $Z_o$. This permits adjustment of $Z_o$ to whatever value is required to achieve the desired $Z_{in}$ at $f_2$ without regard to its effect at $f_1$ and $f_3$ in a relationship expressed by $Z_o=\sqrt{Z_a Z_{in}}$. In an alternate three band antenna the elements are folded to achieve an element physical length reduction by typically ten percent and a structure commonality of parts with structural element sections identical although varied electrical lengthwise. Two element (driven element plus reflector or director) three band antennas are also provided along with three band antennas having a plurality of director elements. Two band antenna arrays are also provided with simplified element matching networks.

Figure 2:
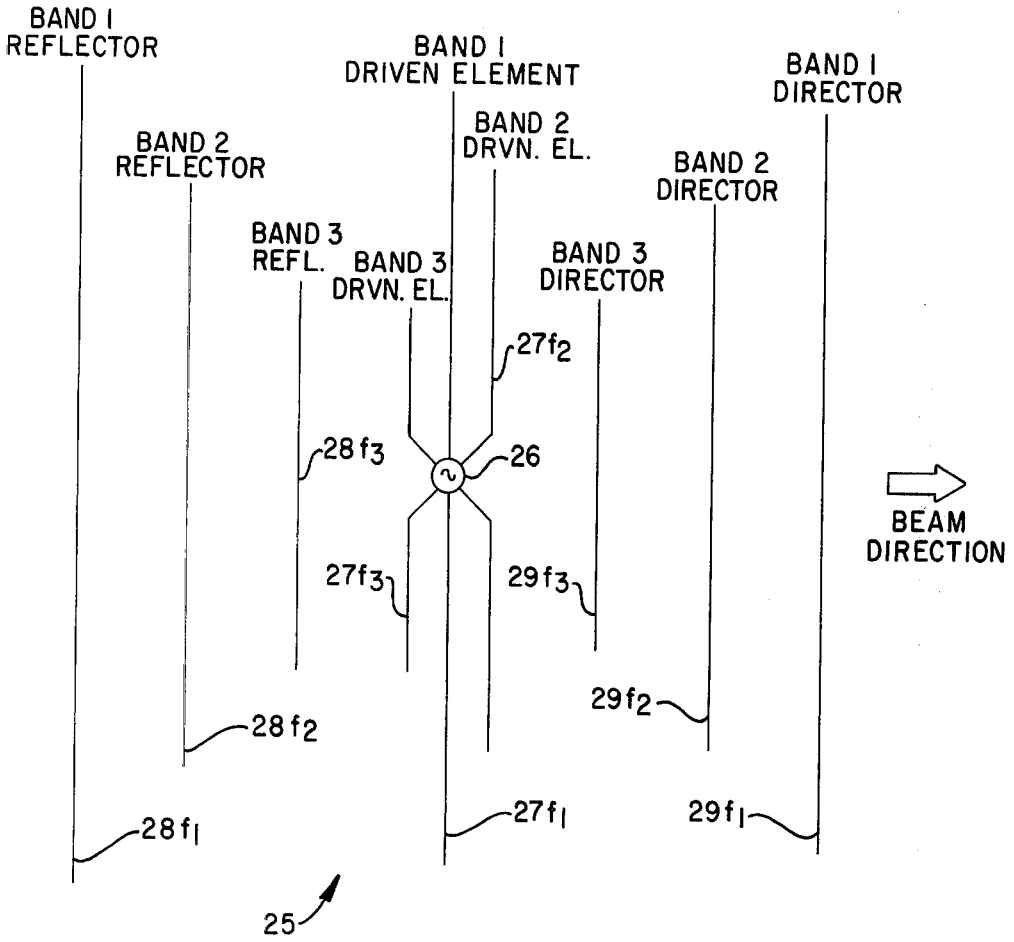
PRIOR ART FIG. 2
Figure 3:
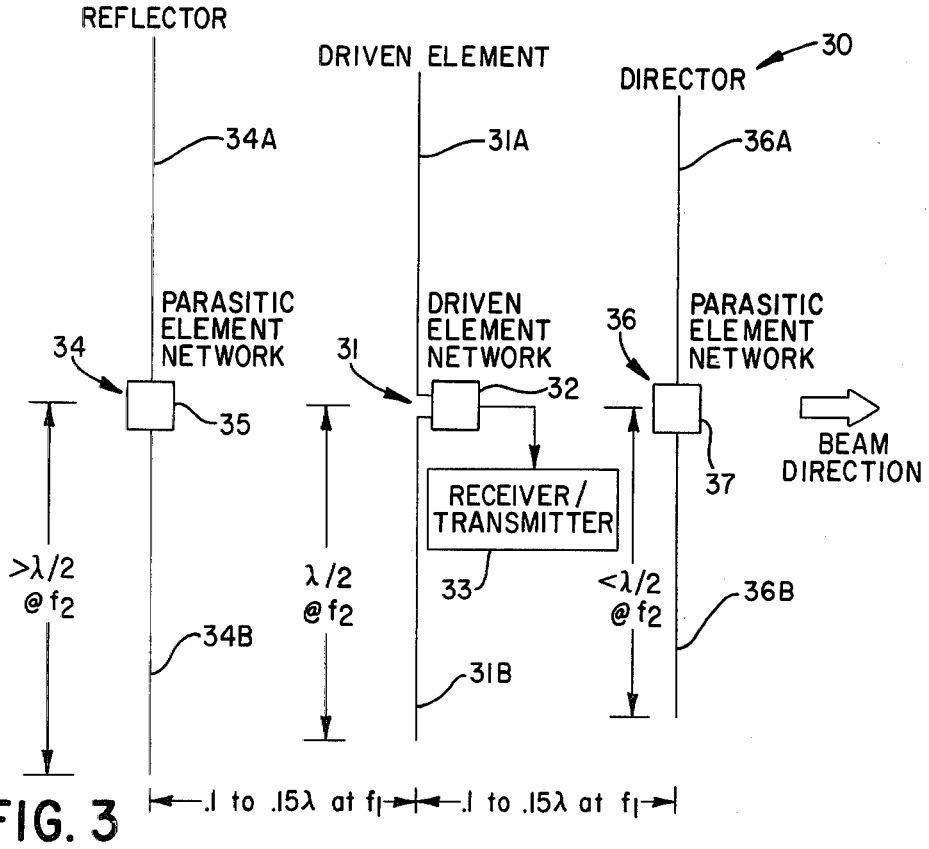
Figure 4A:
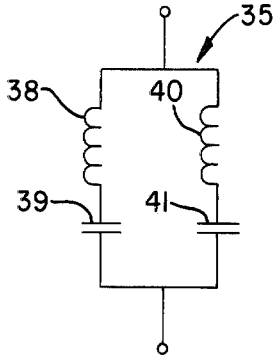
Figure 4B:
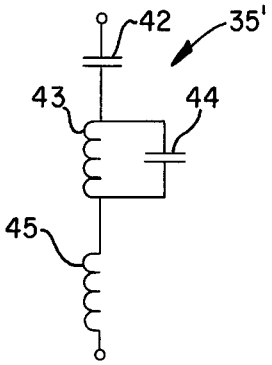
Figure 5:
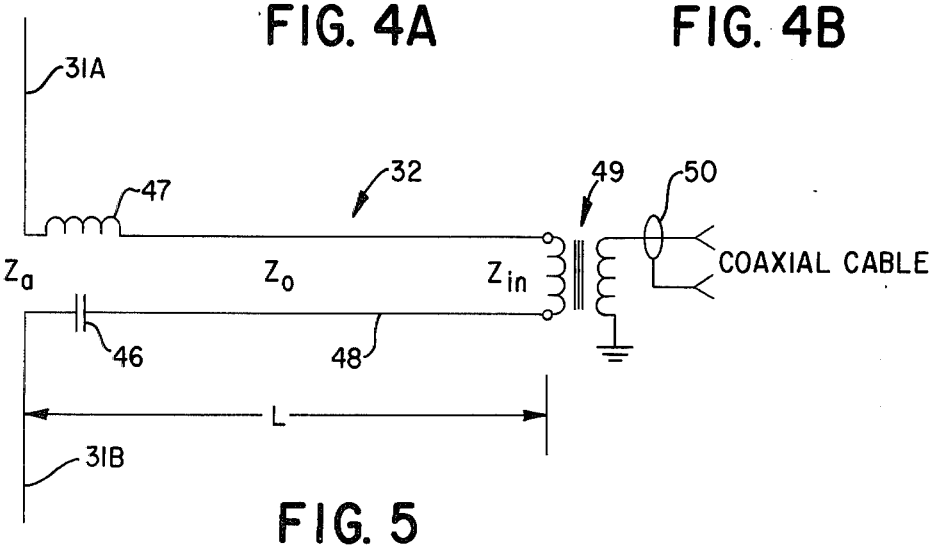
Figure 6:
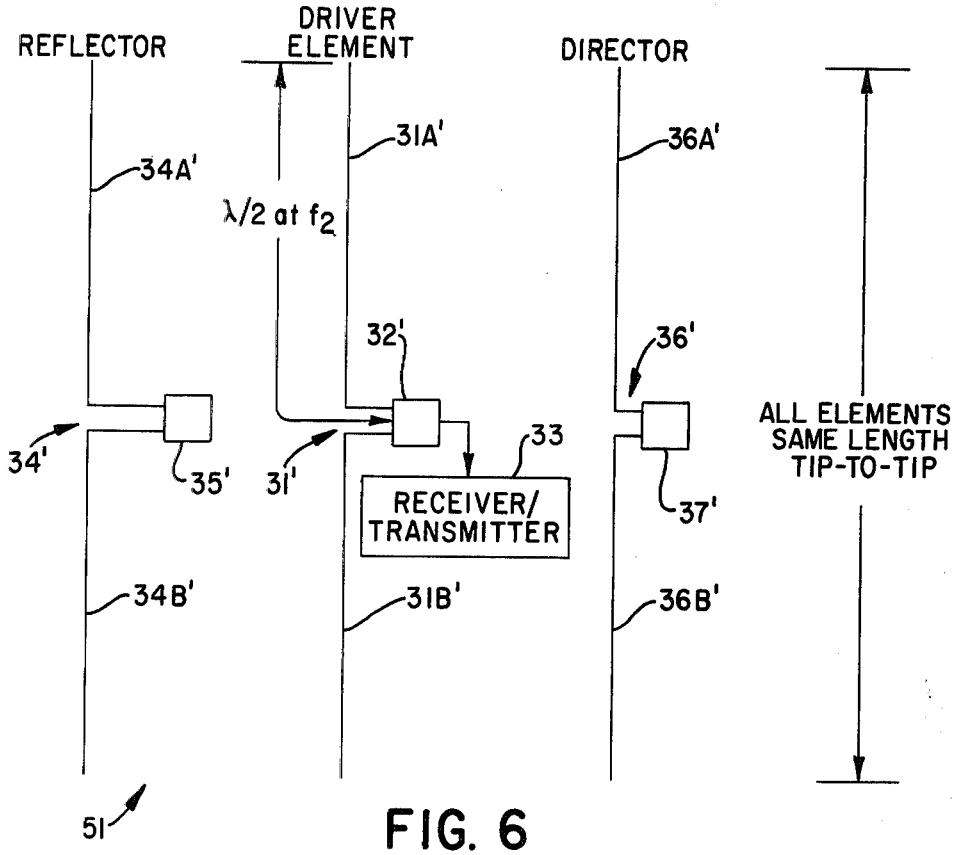
Figure 8A:
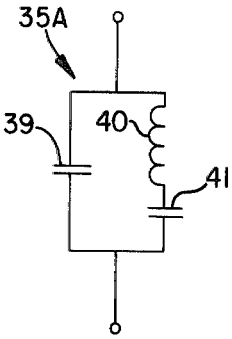
Figure 8B:
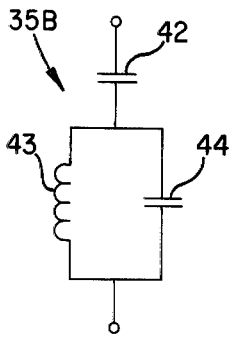
Figure 7:
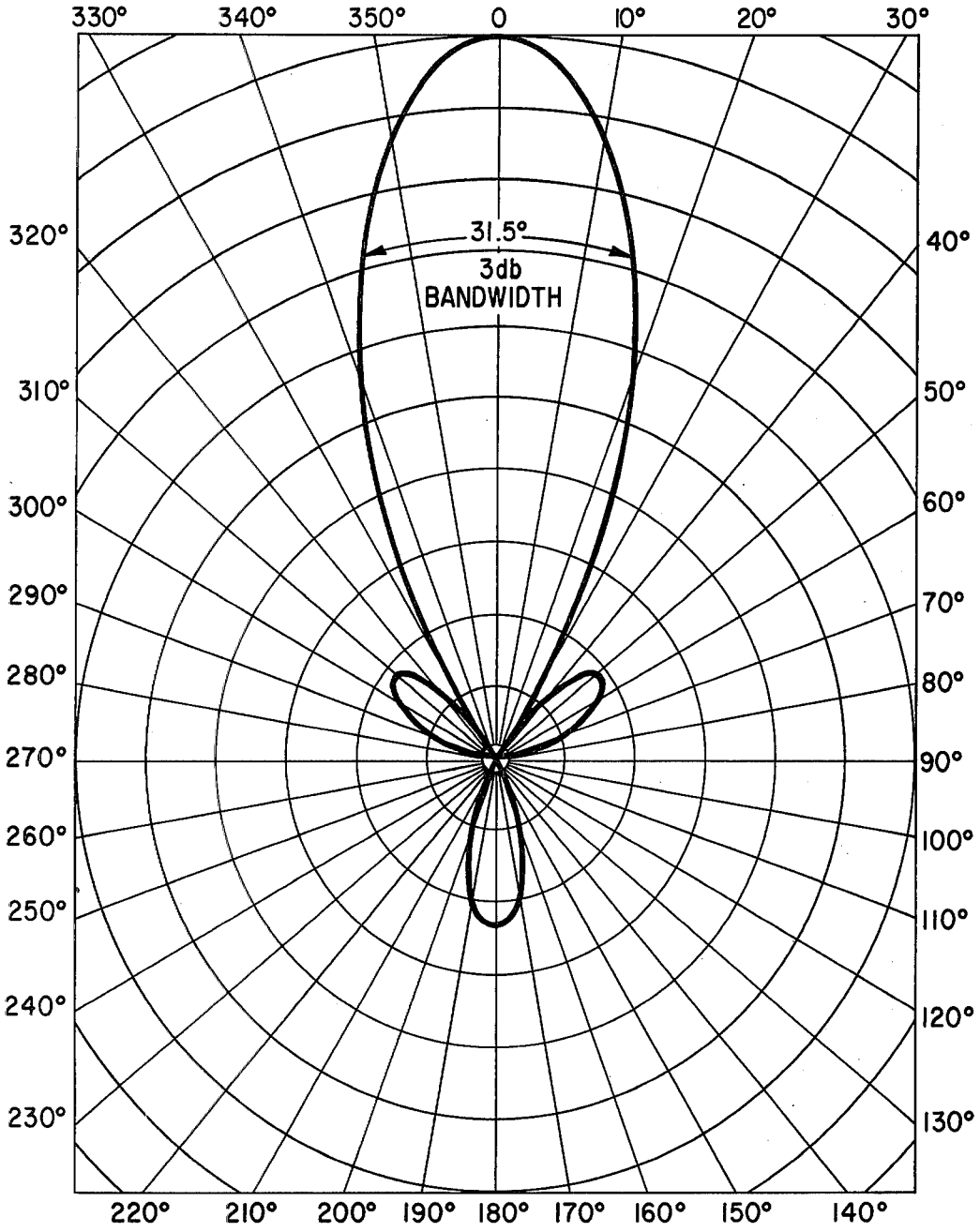

Specific embodiments representing what are presently regarded as the best modes of carrying out the invention are illustrated in the accompanying drawings:

In the drawings:

FIG. 1 represents a schematic of a prior art three band multi-element trap antenna;

FIG. 2, a schematic of a prior art three band separate element antenna;

FIG. 3, a schematic of my improved three band antenna with the driven element two half wave radiators on the middle band frequency, and with reflector and director elements longer and shorter, respectively, than the driven element;

FIGS. 4A and 4B, alternate networks that may be used interchangeably interconnected between opposite end radiators of the respective parasitic reflector and director elements, FIG. 5, a matching network in the feed for the driven element of FIG. 3 with a series capacitor and series inductor and a transmission line transformer;

FIG. 6, an alternate three band three element antenna array with elements folded for commonality of parts and desired electrical length variation for improved operational performance;

FIG. 7, a typical radiation pattern as would be obtained with the antenna embodiment of FIG. 6 where the overall element length is 1.2 wavelength at $f_3$, the high frequency band;

FIGS. 8A and 8B, alternate networks that may be used interchangeably interconnected between opposite end radiators of respective parasitic reflector and director elements of a two band $f_1$, $f_2$ antenna.

Figure 9:
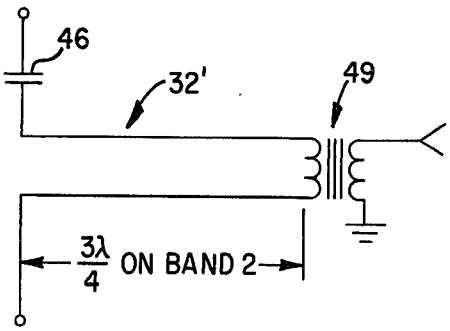
Figure 10A:
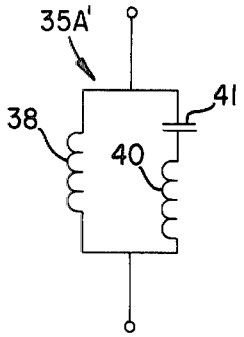
Figure 10B:
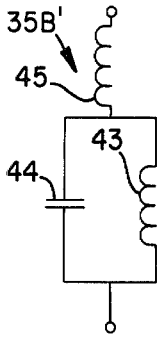
Figure 11:
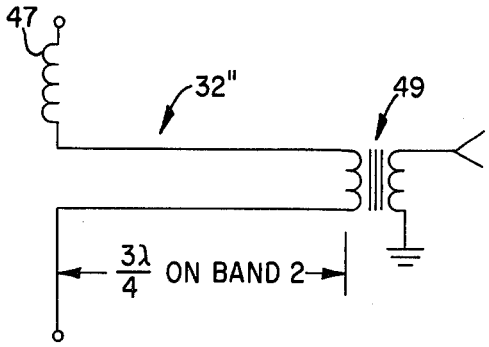
Figure 12:
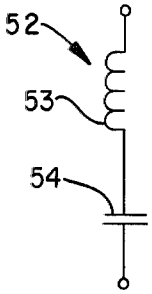
Figure 13:
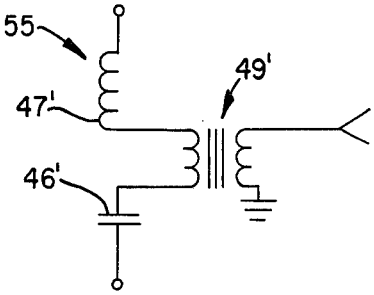
Figure 14:
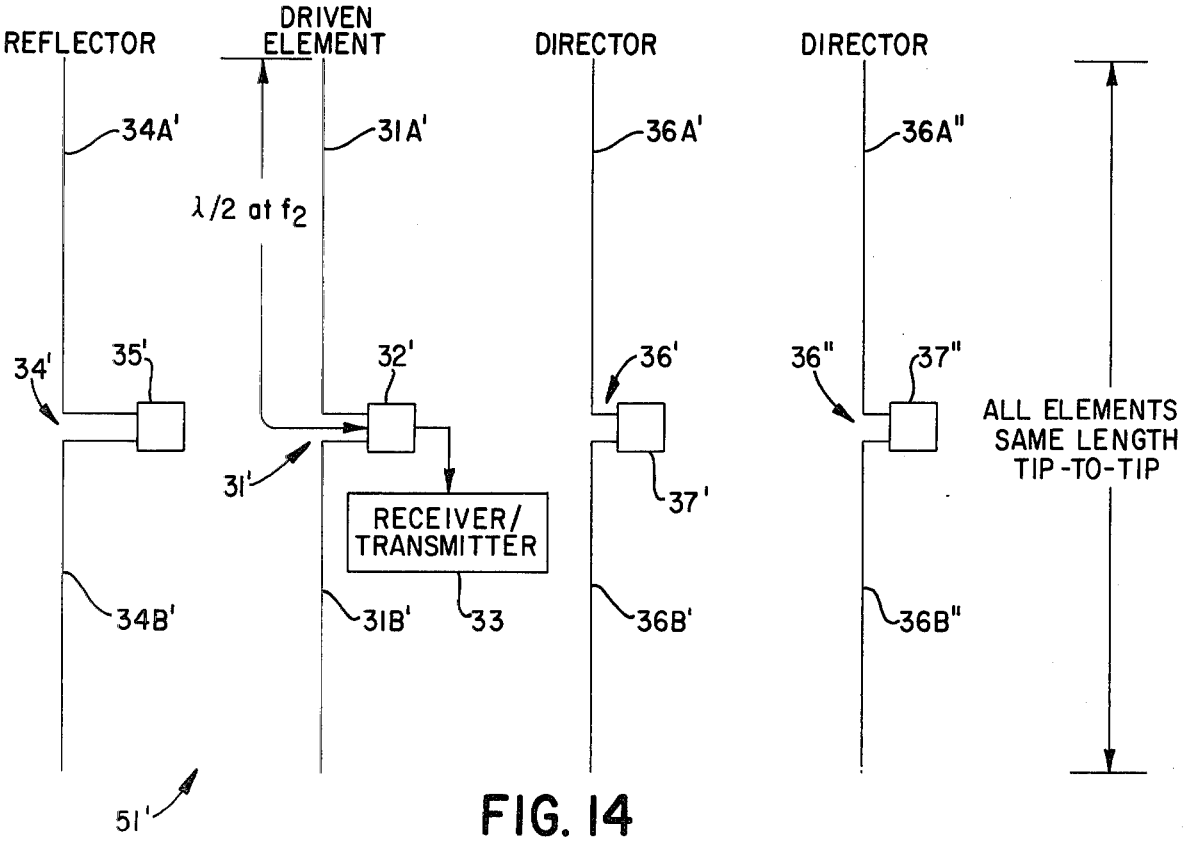
Figure 15:
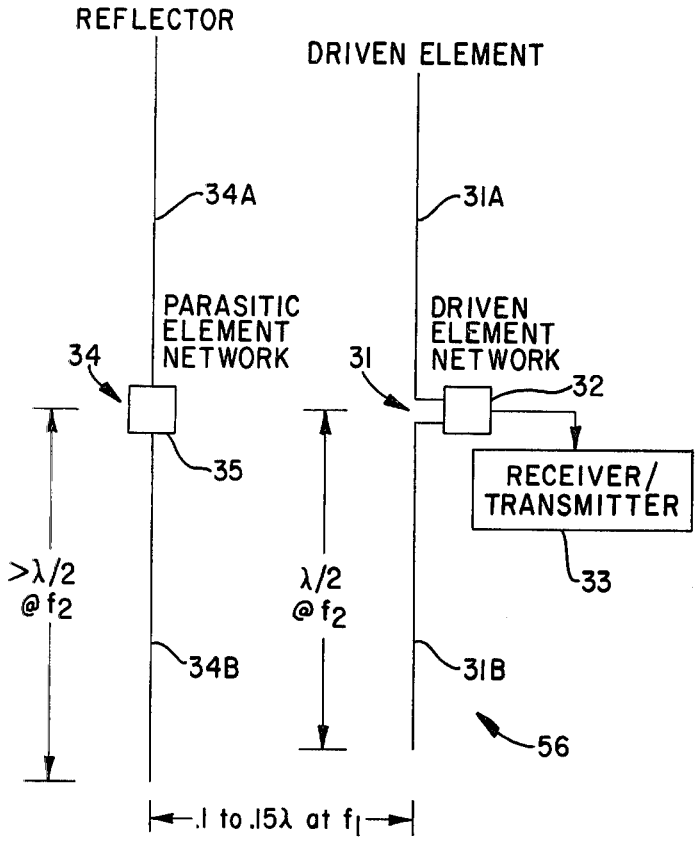
Figure 16:
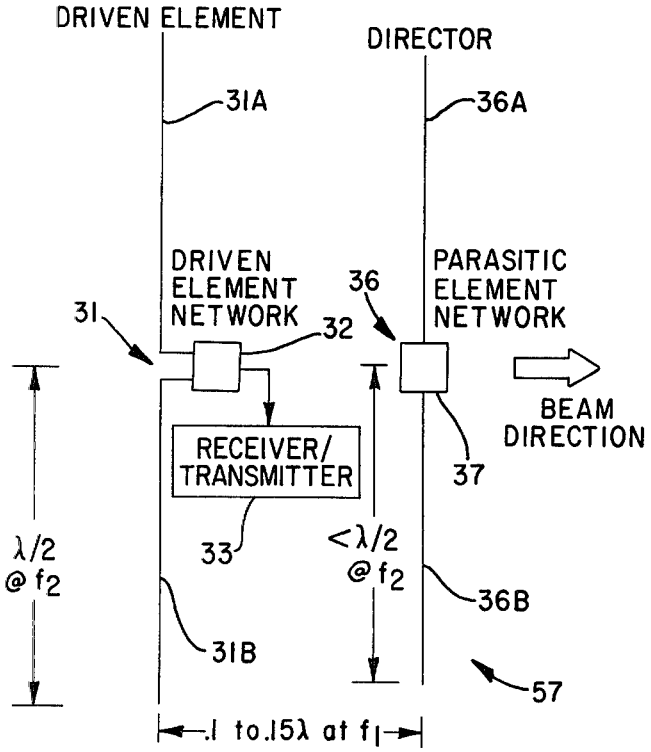

FIG. 9, a matching network in the feed, altered from the network of FIG. 5, for a two band $f_1$, $f_2$ antenna;

FIGS. 10A and 10B, alternate networks that may be used interchangeably interconnected between opposite end radiators of respective parasitic reflector and director elements of a two band $f_2$, $f_3$ antenna;

FIG. 11, a matching network in the feed, altered from the network of FIG. 9, for a two band $f_2$, $f_3$ antenna;

FIG. 12, a network that may be used between opposite end radiators of respective parasitic reflector and director elements of a two band $f_1$, $f_3$ antenna;

FIG. 13, a matching network in the feed for the driven element of a two band $f_1$, $f_3$ antenna with the transmission line transformer of other matching network substantially eliminated;

FIG. 14, a three band four element antenna with elements folded like with the FIG. 6 embodiment but with two director elements in place of one director element;

FIG. 15, a three band (or two band) two element antenna array with a driven element plus reflector element; and, FIG. 16, a three band (or two band) two element antenna array with a driven element plus a director element.

Referring to the drawings:

The prior art three band $f_1$, $f_2$, $f_3$ multi-element trap antenna 20 of FIG. 1 has a center feed 21 driven element 22, a parasitic reflector element 23 and a parasitic director element 24. This is a three band antenna wherein each element structure 22, 23 and 24 includes, respectively, L-C tuned trap circuits 22$f_2$ and 22$f_3$, 23$f_2$ and 23$f_3$, and 24$f_2$ and 24$f_3$ two of each that isolate the element currents to the element section between the traps tuned to the respective particular frequency. With this antenna array reflector elements are resonant at a frequency slightly lower than the operating frequency—typically less than ten percent lower. Correspondingly, director elements are resonant at a frequency slightly higher than the operating frequency.

Another prior art three band $f_1$, $f_2$, $f_3$ multi-element antenna is the Yagi antenna 25 of FIG. 2 with three elements approximately a half wave long effectively provided on each band. The center feed 26 driven elements 27$f_1$, 27$f_2$, and 27$f_3$ are approximately one-half wavelength long, and the corresponding individual reflector elements 28$f_1$, 28$f_2$, and 28$f_3$ are slightly longer while the director elements 29$f_1$, 29$f_2$, and 29$f_3$ are slightly shorter, respectively, than the driven elements.

Many variations of the FIGS. 1 and 2 antennas have been used such as, for example, separate parasitic elements for the highest frequency band $f_3$ and two-band trapped elements for bands $f_1$ and $f_2$. Further arrays with a single parasitic element, reflector or director, have been used as well as arrays with a single reflector and multiple directors. Generally, these approaches have disadvantages such as, requiring a large number of traps, elements provided performing a useful function on only one band, and utilization of full aperture of the antenna only on the lowest frequency band. Extensive structural requirements and/or electrical requirements and limitations are encountered with various array structures of these prior art antennas having a frequency band progression generally 1, 1.5, 2.

The new improved three band $f_1$, $f_2$, $f_3$ antenna 30 of FIG. 3 includes a driven element 31 that is an assembled structure of two half wavelength radiators 31A and 31B, on band 2 at the frequency $f_2$, interconnected by a driven element network 32 that is also connected to a receiver and/or transmitter 33. The antenna reflector 34 is a parasitic element with radiators 34A and 34B interconnected by a network 35 that resonates the reflector element 34 a little below all three bands $f_1$, $f_2$, $f_3$ and with the reflector electronically and physically longer by typically an amount under ten percent than the length of driven element 31. In like manner, the director 36 is a parasitic element with radiators 36A and 36B interconnected by network 37 that resonates the director element 36 a little above all three bands $f_1$, $f_2$, $f_3$ and with the director electronically and physically shorter by an amount generally under ten percent than the length of driven element 31. The networks 35 and 37 which resonate the reflector and director parasitic elements near all three bands provide a capacitive impedance at $f_1$ in the order of 400 ohms for element length-to-diameter ratios of 500; a very high impedance at $f_2$; and an inductive impedance at $f_3$ an impedance value also in the order of 400 ohms. The network shown in FIG. 4A is such a parasitic element network with series connected coil 38 and capacitor 39 connected in parallel with series connected coil 40 and capacitor 41. With a three band antenna 30 designed for operation at 14, 21 and 28 MHz as the $f_1$, $f_2$ and $f_3$ bands values of network 35 components are, respectively, coil 38≅8 μh, capacitor 39≅9.5 pf, coil 40≅9.6 μh, and capacitor 41≅5.0 pf. Network 35 in the reflector element 34 becomes network 37 when used with the director element 36. The alternate parasitic element network 35' of FIG. 4B includes a capacitor 42 series connected to parallel connected coil 43 and capacitor 44 that are in turn connected in series with coil 45 as a network that may be used in place of the network 35 in reflector element 34 and in director element 36 in place of network 37. Obviously, an appropriate set of compenent values would have to be used to attain substantially the same operational performance as with network 35.

The driven element 31 matching network 32, as shown in FIG. 5, has a series capacitor 46 and series inductor 47 which have values such as to resonate the driven element at $f_1$ and $f_3$, and a transmission line transformer 48 of length L that transforms the high value of driven element input impedance $Z_a$ at $f_2$ to a lower value at $Z_{in}$, equal to the value of $Z_a$ for the other two bands. This requires that transmission line transformer length L be electrically $\frac{3}{4}$ wavelength at $f_2$. Since L is then one half wavelength at $f_1$ and one wavelength at $f_3$, $Z_{in}=Z_a$ on those two bands regardless of the valve of the transmission line characteristic impedance $Z_o$. Thus, $Z_o$ can therefore be adjusted to whatever value is required to achieve the desired $Z_{in}$ at $f_2$ without regard to its effect at $f_1$ and $f_3$, with the relationship being expressed by $Z_o=\sqrt{Z_aZ_{in}}$. With suitable adjustment of the parasitic element network values and element lengths it is possible to achieve a nominal value of $Z_a$ (and therefore $Z_{in}$) of 50 ohms at $f_1$ and $f_3$. Thus the only additional requirement is to provide a 1:1 balance-to-unbalance transformer 49 to match $Z_{in}$ to common 50 ohm coaxial cable 50. Since $Z_a$ at $f_2$ is typically in the order of 1000 to 3000 ohms, $Z_o$ of the transmission line transformer 48 must typically be in the order of several hundred ohms, a value that is a convenient value for commercially available balanced transmission line. With the three band antenna 30 as designed for operation at 14, 21 and 28 MHz component values in matching network 32 are, capacitor 46≅16 pf and coil 47≅4 μh.

Radiation patterns for the antenna array 30 of FIG. 3 display sidelobes on the high frequency band $f_3$ that are undesirably large for some applications—sidelobes produced by the great relative electrical length of the array elements at $f_3$. The alternate antenna array 51 of FIG. 6 achieves a reduction in sidelobe levels without significantly affecting the other properties of the antenna through use of folded elements. The antenna array 51 of FIG. 6 is a three band $f_1$, $f_2$, $f_3$ antenna having many features in common with antenna 30 of FIG. 3, and includes a driven element 31' that is an assembled structure of two half wavelength folded radiators 31A' and 31B', on band 2 (frequency $f_2$) interconnected by a driven element matching network 32' that is also connected to a receiver and/or transmitter 33. The antenna reflector 34' is a parasitic folded element with folded radiators 34A' and 34B' interconnected by a network 35' that resonates the reflector element 34' near all three bands $f_1$, $f_2$, $f_3$ and with the reflector electronically longer, through the folded radiators, by typically an amount under ten percent than the length of driven element 31'. In like manner, the director 36' is a parasitic folded element with folded radiators 36A' and 36B' interconnected by a network 37' that resonates the director element 36' near all three bands $f_1$, $f_2$, $f_3$ and with the director electronically shorter, through the folded radiators, by typically an amount under ten percent than the length of driven element 31'. The driven element 31' matching network 32' may be the network of FIG. 5, and parasitic element networks 35' and 37' may be the network of either FIG. 4A or FIG. 4B. The folded element antenna 51 of FIG. 6 is advantageously a smaller, more tractable antenna structure physically since element length is reduced by typically ten percent from that of a non folded element antenna array. There is also an increased commonality of parts with lateral tip-to-tip length the same for all elements with the folded element antenna 51. It should be noted, however, that element tip-to-tip length may vary with some folded element antenna arrays, and there may be compound antenna arrays with less than all of the array elements folded elements as may be desired for specific operational purposes.

A typical radiation pattern is shown in FIG. 7 for the folded element antenna embodiment of FIG. 6 where the overall element length is 1.2 wavelength of $f_3$ (e.g. 28 MHz), the high frequency band. The FIG. 6 antenna array produces unidirectional beams on bands $f_1$ and $f_2$ and 3 db beamwidths in the order of 60 and 40 degrees respectively.

The three bands $f_1$, $f_2$, $f_3$ antenna arrays 34 of FIG. 3 and 34' of FIG. 6 may be transformed to two band $f_1$, $f_2$ antenna arrays by changing the parasitic element networks 35 and 37, and 35' and 37' from the FIG. 4A or 4B circuit to the FIG. 8A or 8B circuit, and the driven element matching network 32 and 32' from the FIG. 5 circuit to the FIG. 9 circuit. The element network 35A of FIG. 8A is shown to be substantially the same as the network 35 of FIG. 4A except that inductor coil 38 is removed with, however, the other components numbered the same, as a matter of convenience, even though component values would be changed. In like manner, the element network 35B of FIG. 8B is substantially the same as the network 35' of FIG. 4B except that inductor coil 45 is removed and component values are changed. The driven element matching network 32' of FIG. 9 is shown to be substantially the same as the network 32 of FIG. 5 except that inductor coil 47 is removed and component values changed with, however, respective components numbered the same. Thus, with an array for bands $f_1$, $f_2$ (14 and 21 MHz) an inductor is deleted from each network.

The three band $f_1$, $f_2$, $f_3$ antenna arrays 34 of FIG. 3 and 34' of FIG. 6 may also be transformed to two band $f_2$, $f_3$ antenna arrays by changing the parasitic element networks 35 and 37, and 35' and 37' from the FIG. 4A or 4B circuit to the FIG. 10A or 10B circuit, and the driven element matching network 32 and 32' from the FIG. 5 circuit to the FIG. 11 circuit. The element network 35A' of FIG. 10A is substantially the same as the network 35 of FIG. 4A except that capacitor 39 is removed and component values are changed. In like manner, the element network 35B' of FIG. 10B is substantially the same as the network 35' of FIG. 4B except that capacitor 42 is removed and component values are changed. The driven element matching network 32'' of FIG. 11 is substantially the same as the network 32 of FIG. 5 except that capacitor 46 is removed and component values changed with, however, respective components being numbered the same. Thus, with an array for bands $f_2$, $f_3$ (21 and 28 MHz) a capacitor is deleted from each network.

The three band $f_1$, $f_2$, $f_3$ antenna arrays 34 of FIG. 3 and 34' of FIG. 6 may also be transformed to two band $f_1$, $f_3$ antenna arrays by changing the parasitic element networks 35 and 37, and 35' and 37' from the FIG. 4A or 4B circuit to the FIG. 12 circuit, and the driven element matching network 32 and 32' from the FIG. 5 circuit to the FIG. 13 circuit. The matching network 52 of FIG. 12 is a simple series L-C circuit with coil 53 in series with capacitor 54 that is in essence half of circuit 35, a circuit it replaces for this embodiment. The driven element matching network 55 of FIG. 13 has the transmission line transformer 48 removed from the network 32 of FIG. 5, and the component values of capacitor 46' and coil 47' are changed from their counterparts in network 32. Value variances may also exist in transformer 49' from transformer 49 of network 32. Thus, arrays for bands $f_1$, $f_3$ (e.g., 14 and 28 MHz) are provided where matching provisions for a middle band $f_2$ (e.g., 21 MHz) are removed.

Additional director elements may be added to any of the three band antenna arrays or two band modifications thereof, presented herein such as typified in FIG. 14. The folded element antenna array 51' of FIG. 14 is substantially the same as the folded element antenna array 51 of FIG. 6 except that it has an additional director element 36'' added that is substantially the same as director element 36' but spaced forwardly therefrom in the prime direction of electromagnetic signal radiation propagation. The folded radiators 36A'' and 36B'' of element 36'' are substantially duplicates of their counterparts 36A' and 36B' of element 36', and network 37'' is substantially the same as network 37'. It should be noted, however, that director 36'' could be varied from 36' as may be desired for same operational requirements and that more directors could be added to antenna arrays for special operational purposes. Further, additional director elements could be added in addition to director 36 in the embodiment of FIG. 3 with the additional director (or directors) duplications of director 36 or progressively shorter with their successive order of position in the direction of signal beam propagation.

A three band (or two band) two element array 56 of FIG. 15 is presented that is actually the same as the embodiment of FIG. 3, in its varied forms, other than that the director 36 is removed. The reflector element 34 and driven element 31 carry the same component numbers as a matter of convenience without being described again here since their functions are essentially the same.

With the three band (or two band) two element array 57 of FIG. 16, the two elements are the driven element 31 and a director element 36 again carrying the same component numbers as with the embodiment of FIG. 3 since they are essentially the same other than that the reflector element 34 is removed. It should be noted that additional directors could be added to this two element array to form arrays having a driven element and a plurality of directors just as has been described as modification for the FIG. 3 and FIG. 6 embodiments. Further, both the FIG. 15 and 16 embodiments could employ folded radiator element structures as have been described for the FIG. 6 and 14 embodiments.

Whereas this invention is herein illustrated and described with respect to several embodiments hereof, it should be realized that various changes may be made without departing from essential contributions to the art made by the teachings hereof.

I claim:

1. In a multi-band multi-element directional antenna array having a driven element means formed of two opposed sections each a half wavelength at the midband frequency and parasitic element means: driven element impedance matching network means; a parasitic element; parasitic element center network means; signal feed line means; signal coupling means interconnecting said signal feed line means and said driven element; and with said driven element matching network means and said parasitic element center network means being networks enabling respective driven and parasitic elements to respond, as an antenna array, on all bands of said multi-band directional antenna for providing a unidirectional radiation pattern.

2. The multi-band directional antenna of claim 1, wherein said parasitic element is a reflector element.

3. The multi-band directional antenna of claim 1, wherein said parasitic element is a director element.

4. The multi-band directional antenna of claim 1, wherein said parasitic element is one of a plurality of parasitic elements.

5. The multi-band directional antenna of claim 4, wherein said parasitic elements are all director elements.

6. The multi-band directional antenna of claim 5, wherein a plurality of the antenna elements are folded elements.

7. The multi-band directional antenna of claim 6, wherein all folded elements of said antenna are of equal tip-to-tip length.

8. The multi-band directional antenna of claim 4, wherein said parasitic element is a reflector element; and parasitic director means is also included in the antenna array.

9. The multi-band directional antenna of claim 8, wherein the elements of said antenna array are folded elements.

10. The multi-band directional antenna of claim 9, wherein said parasitic director means is a plurality of spaced director elements.

11. The multi-band directional antenna of claim 1, wherein said antenna array is an antenna providing a unidirectional signal radiation pattern with matching networks at the centers of respective array elements tuned as an array to three radio frequency bands at $f_1$, $f_2$, $f_3$ band nominal center frequencies related substantially by the progression 1, 1.5, 2.

12. The multi-band directional antenna of claim 11, wherein each parasitic element matching network is structured to provide a capacitive impedance at the low band frequency $f_1$, a very high impedance at the middle band frequency $f_2$, and an inductive impedance at the high band frequency $f_3$.

13. The multi-band directional antenna of claim 12, wherein the driven element matching network includes, series capacitive means, and series inductive means that together resonate said driven element at the low and high band frequencies $f_1$ and $f_3$; and a transmission line transformer means of predetermined length to yield required impedance at the middle frequency $f_2$ to impedance match at frequency $f_2$.

14. The multi-band directional antenna of claim 13, wherein the driven element matching network series capacitive means and series inductive means are a capacitor and a coil series connected with said transmission line transformer means; and with said transmission line transformer means of length electrically $\frac{3}{4}$ wavelength of the middle frequency $f_2$.

15. The multi-band directional antenna of claim 12, wherein a matching network, for a parasitic element, connected between opposite end radiators of the parasitic element includes, a first series connected coil and capacitor circuit connected in parallel with a second series connected coil and capacitor circuit.

16. The multi-band directional antenna of claim 12, wherein a matching network for a parasitic element, connected between opposite end radiators of the parasitic element includes, a capacitor series connected to a parallel connected coil and capacitor circuit connected also in series with a coil.

17. The multi-band directional antenna of claim 1, wherein said antenna array is an antenna, providing a unidirectional signal radiation pattern with matching networks at the centers of respective array elements, tuned as an array to two radio frequency bands $f_1$, $f_2$ band nominal center frequencies related substantially by the progression 1, 1.5.

18. The multi-band directional antenna of claim 17, wherein a parasitic element center matching network is structured to provide a capacitive impedance at the low band frequency $f_1$, and a very high impedance at the band frequency $f_2$.

19. The multi-band directional antenna of claim 18, wherein said parasitic element center matching network, is connected between opposite end radiators of the parasitic element, and includes, a capacitor in parallel with a series connected coil and capacitor circuit.

20. The multi-band directional antenna of claim 18, wherein said parasitic element center matching network, is connected between opposite end radiators of the parasitic element, and includes, a capacitor in series with a parallel connected capacitor and coil circuit.

21. The multi-band directional antenna of claim 17, wherein the driven element matching network includes, series capacitive means that resonates said driven element at the low band frequency $f_1$; and a transmission line transformer of predetermined length to yield required impedance at the frequency $f_2$ to impedance match the driven element at frequency $f_2$.

22. The multi-band directional antenna of claim 21, wherein said transmission line transformer lengthwise is $\frac{3}{4}$ wavelength of the frequency $f_2$.

23. The multi-band directional antenna of claim 1, wherein said antenna array is an antenna, providing a unidirectional signal radiation pattern with matching networks at the centers of respective array elements, tuned as an array to two radio frequency bands at $f_2$, $f_3$ band nominal center frequencies related substantially by the progression 1.5, 2.

24. The multi-band directional antenna of claim 23, wherein a parasitic element center matching network is structured to provide a very high impedance at the band frequency $f_2$, and an inductive impedance at the band frequency $f_3$.

25. The multi-band directional antenna of claim 24, wherein said parasitic element center matching network, is connected between opposite end radiators of the parasitic element, and includes, a coil in parallel with a series connected coil and capacitor circuit.

26. The multi-band directional antenna of claim 24, wherein said parasitic element center matching network, is connected between opposite end radiators of the parasitic element, and includes, a coil in series with a parallel connected capacitor and coil circuit.

27. The multi-band directional antenna of claim 23, wherein the driven element matching network includes, series inductive means that resonates said driven element at the high band frequency $f_3$; and a transmission line transformer of predetermined length to yield required impedance at the frequency $f_2$ to impedance match the driven element at frequency $f_2$.

28. The multi-band directional antenna of claim 27, wherein said transmission line transformer lengthwise is $\frac{3}{4}$ wavelength of the frequency $f_2$.

29. The multi-band directional antenna of claim 1, wherein said antenna array is an antenna, providing a unidirectional signal radiation pattern with matching networks at the centers of respective array elements, tuned as an array to two radio frequency bands at $f_1$, $f_3$ band nominal center frequencies related substantially by the progression 1, 2.

30. The multi-band directional antenna of claim 29, wherein a parasitic element center matching network is structured to provide a capacitive impedance at the lower band frequency $f_1$, and an inductive impedance at the high band frequency $f_3$.

31. The multi-band directional antenna of claim 30, wherein said parasitic element center matching network, is connected between opposite end radiators of the parasitic element, and includes, a series connected coil and capacitor circuit.

32. The multi-band directional antenna of claim 29, wherein the driven element matching network includes series connected capacitive means and inductive means that with the network resonate said driven element at the low and high band frequencies $f_1$ and $f_3$.

* * * * *